United States Patent [19]

Huemer

[11] Patent Number: 4,574,846

[45] Date of Patent: Mar. 11, 1986

[54] ARRANGEMENT FOR TENSION CONTROL AND SUPERVISION OF INDIVIDUAL WARP THREADS ON A LOOM, PARTICULARLY A CIRCULAR LOOM

[76] Inventor: Franz X. Huemer, Sonnenuhrgasse 4, 1060 Vienna, Austria

[21] Appl. No.: 587,168

[22] Filed: Mar. 7, 1984

[30] Foreign Application Priority Data

Mar. 16, 1983 [CH] Switzerland ..... 1448/83

[51] Int. Cl.[4] ..... D03D 51/28

[52] U.S. Cl. ..... 139/353; 139/13 R; 66/163

[58] Field of Search ..... 139/13 R, 16, 336 R, 139/349, 350, 353, 354; 66/163

[56] References Cited

U.S. PATENT DOCUMENTS 2,121,375 6/1938 Wachsman ..... 66/163
2,804,761 9/1957 Lebocey ..... 66/163

FOREIGN PATENT DOCUMENTS 215121 7/1939 Switzerland ..... 139/353
828878 2/1960 United Kingdom ..... 139/353

*Primary Examiner*—Henry S. Jaudon
*Attorney, Agent, or Firm*—Karl F. Ross; Herbert Dubno

[57] ABSTRACT

The arrangement comprises a two-armed movable lever, which is swivel-supported on the loom and which is held by a warp thread, found in a stretched state and guided through a yarn guiding eyelet on the one movable lever arm, countering the effect of a spring means, which engages on the lever arm that is free of eyelet, and which is in a regulating position, which compensates the alternating tension on the warp thread, with the movable lever closing an electric circuit when brought into signal position as a result of the unstretched or missing warp thread. Thereby, the movable lever arm comprises a spring wire, the eyelet-free lever arm of which, stands in the regulating position of the movable lever on a stop, and of which the carrying arm, with the eyelet, bends under increasing tension in the direction of withdrawal of the warp thread, and, it must be added, that at least one further stop is disposed in the deflection path of the arm carrying the eyelet, in order to vary the deflection characteristics thereof.

5 Claims, 3 Drawing Figures

ARRANGEMENT FOR TENSION CONTROL AND SUPERVISION OF INDIVIDUAL WARP THREADS ON A LOOM, PARTICULARLY A CIRCULAR LOOM

BACKGROUND OF THE INVENTION

The present invention relates to a new and improved arrangement for tension control and supervision of individual warp threads on a loom, particularly a circular loom.

More specifically, the invention relates to an arrangement for tension control and supervision of individual warp threads on a loom, particularly a circular loom, comprising a two-armed movable lever, which is swivel-supported on the loom and which is held by a warp thread, found in a stretched state and guided through a yarn guiding eyelet on the one movable lever arm, countering the effect of a spring means, which engages on the lever arm that is free of eyelet, and which is in a regulating position, which compensates the alternating tension on the warp thread, with the movable lever closing an electric circuit when brought into signal position as a result of the unstretched or missing warp thread.

With weaving looms, particularly circular looms, the formation of the shed leads to great changes in the tension on the warp threads, the compensation of which is absolutely essential. This compensation of tension poses a great problem, which has not been sufficiently solved with the means of the prior art until this present day.

With one such arrangement of the aforementioned kind, conventionally known in the art, by which two kinds of springs engage on the movable lever for the taking in of the changes of tension on the warp threads, these springs call for a moment of rotation which is dependent on the tension of the warp thread, running through the eyelet of the movable lever. One of these springs is arranged in such a way that it only comes into effect when the angle of rotation of the lever exceeds a permissible area. Moreover, the back side of the movable lever carries an electric-conducting coating, in order to bridge the contact of a switch when in one of its extreme positions with unstretched or missing warp thread.

Such an arrangement is, howeever, defective and unsuited in fulfilling the requirements of today. For example, the movable lever employed in accordance with the above-mentioned patent specification is relatively heavy, not least owing to its necessary stability for engaging two tension springs and the required electric coating. This, however, makes the lever sluggish, so that this only delays the change of tension—if it can ensue at all. Moreover, this known arrangement is very complicated, requires exact spring characteristics and a precise setting of the movable lever as regards the switch contact by which this is to be bridged. Both the installation and the replacement of the movable lever on the loom are exceptionally costly and time-consuming.

SUMMARY OF THE INVENTION

Therefore, with the foregoing in mind it is a primary object of the present invention to provide a new and improved construction of an arrangement for the tension control and supervision of individual warp threads on a loom, particularly a circular loom, which, with the avoidance of the described disadvantages of the prior art, fulfils all the requirements confronted with today.

Another and more specific object of the present invention aims at providing an arrangement of the previously mentioned type, which shall allow for a very light movable lever, which continuously and exactly compensates ensuing tension by a great amplitude of oscillations of the warp thread, without overburdening the warp thread, and which is, moreover, suited to by easily replaced by the simplest conception of the entire arrangement.

Now in order to implement these and still further objects of the invention, which will become more readily apparent as the description proceeds, the arrangement of the present development is manifested by the features that the movable lever arm comprises a spring wire, the eyelet-free lever arm of which stands in the regulating position of the movable lever on a stop, and of which the carrying arm with the eyelet, bends under increasing tension in the direction of withdrawal of the warp thread, and, it must be added, that at least one further stop is disposed in the deflection path of the arm carrying the eyelet, in order to vary the deflection characteristics thereof.

As may be easily seen, the movable lever is here a relatively light and continuously exact element with its own, according to invention even temporarily, changable spring characteristic, which permits the abandonment of tension springs hitherto employed. With appropriate position allocation, even the restoring spring may be abandoned, by the movable arm then itself falling back into its signal position when the tension of the warp thread rapidly falls away, for instance through thread breakage.

Without affecting the spring characteristic of the movable lever thereby, it is possible that a restoring spring engages on the free end of the eyelet-free lever arm and acts thereon in the direction of the signal position, the other end of said spring being attached to an anchoring fixture on the loom.

It is then preferable if thereby the spring-wire movable lever, with a formed holder for lever, is seated on its pivot shaft by way of a collar with terminal flanges, which are interfacial and the shape of a disc, the clearance approximately corresponding to the strength of the spring wire, by which the movable lever is given an exact lateral guidance, which counteracts a lateral free vibration of the thread.

This construction permits in ideal manner the spring-wire movable lever as a movable contact arm in the electric circuit of a switching arrangement for producing a stop signal for the loom, with the one pole of the electric circuit consisting of the anchoring fixture for the restoring spring, and the other pole consisting of the stop that limits the signal position of the movable lever and with the collar, which supports the movable lever, consisting of an electric insulating material.

A very simple assembly and exchangeability is in addition given if the casing has a slot, parallel with the axle and serving to press the casing radially on the pivot shaft.

With this there results for the warp thread tension control and supervisory arrangement according to invention on a circular loom, in which shed running means are arranged in a circle around a circular reed that is running a plurality of warp threads, an important simplification if a spring-wire movable lever is provided for each warp thread, all of which the said movable levers, the pivot shafts, the stops, the current-carrying signal position stop, as well as the current-carrying anchoring fixture for the restoring spring in the form of circular surrounding rods, are common with the circular reed resp. the shed-forming means.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
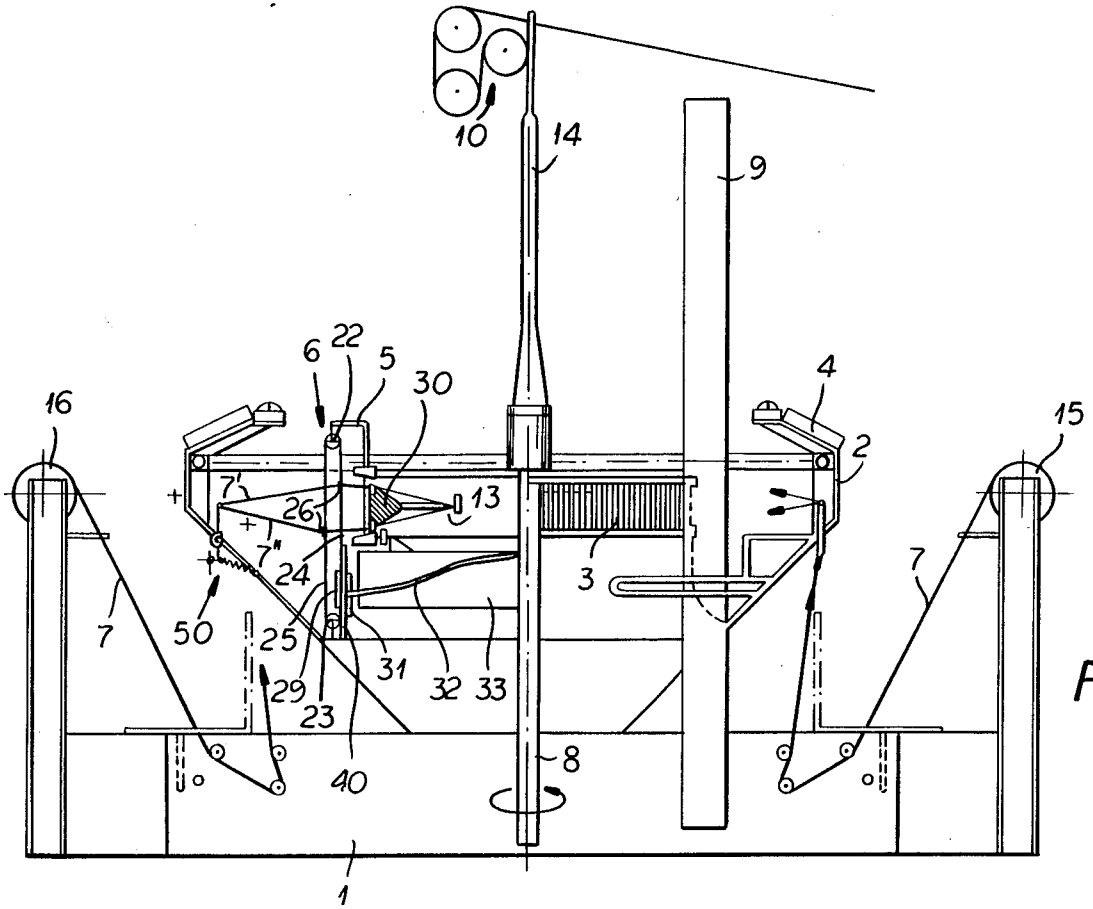
FIG. 1 is a schematic side elevation of a circular loom.

Describing now the drawings, the circular loom according to FIG. 1 rests in per se known manner on a loom base 1, which supports a circular frame carrier 2, carrying a circular reed 3, an on/off switch 4 for the loom and further frame portions 5 for the support of shafts 6. These shafts 6 are in generally known manner arranged in a circle around the main shaft 8 of the loom, and, in the main, build up the shed-forming means of the machine. Furthermore, the support 9 for the cloth draw-off mechanism is supported on the loom base 1, which is here indicated only by the cloth draw-off rollers 10. A fabric spreader 14 is also disposed in the draw-off area. Further, in the circular loom illustrated, it is also possible to see the draw-in roller 15 for the warp threads on the left-hand side, and the draw-in roller 16 for the warp threads on the right-hand side. These warp threads 7, the course of which is only indicated, are devided into two circumferentially disposed warp thread gatherings and are drawn off in the known manner by groups of warp thread spools, which are not illustrated more closely here. For the formation of the weaving shed, one of these thread gatherings is lifted up while the other is guided down from the level of the weaving plane through the so-called change of shed motion, so that a warp top shed 7' and a warp lower shed 7'' result. In this so-called weaving- or multiphase shed, a shuttle 30 with a weft yarn bobbin, not shown here, is passed through on a horizontal path. Owing to the circular motion of the shuttle, the weft yarn wound off from the weft yarn bobbin is transferred onto the edge 13 of the circular fabric. The tubular weave can then be drawn off and laid together as a flat tubular fabric.

In order to produce the previously mentioned shed-forming operation, a plurality of healds 6 are arranged in a circle around the main shaft 8 of the loom near the outer shell of the circular reed 3. As can be seen in FIG. 1, each heald 6 comprises, for example, partial healds 24 and 25, being formed by belt strands. For example, an endless belt can, for this purpose, be guided over each of the rotatably supported guide pulleys 22 resp. 23 on the upper resp. lower part of the frame 5.

The inner strand 24 and the outer strand 25 of the belt have in each case yarn guiding eyelets 26, through each of which a warp thread 7 of one or the other of the warp thread gatherings 7' or 7'' is pulled, the making of a countercurrent up-and-down alternating motion of the strands 24 and 25 the belt produce, then, the previously mentioned change-of-shed motion on both warp thread gatherings.

For this alternating motion, it is known that preferably the inner strand 24 is tightly connected below the yarn guiding eyelets 26 with a so-called shuttle slide 29, which is slidable up and down on movement control means. Projecting from this vertical slide 29 are guide rollers 31, which are supported by way of a cam profile 32, revolving on a corresponding plate cam 33, which is central with the main shaft 8 of the loom.

To the extent described above, the construction of the circular loom corresponds to the prior arts, so that further explanation of such a loom is unnecessary.

The problem that is to be taken into consideration here on such a circular loom as before described, has its existance in the very great tension changes on the warp thread, owing to obvious reasons of the described change of shed, which requires an effective tension compensation.

For this, according to invention, an arrangement 50 is provided for regulating the tension and for the supervision of the warp threads, as is described in detail below in particular by means of FIG. 2.

This arrangement 50 for regulating the tension and for the supervision of the warp threads 7, comprises for each warp thread 7 an own movable lever arm 51, 52, comprising a spring wire, the eyelet-free lever arm 52 of which stands in the regulating position of the movable lever on a stop 54, and of which the carrying arm 51, with the eyelet 53, bends under increasing tension in the direction of withdrawal of the warp thread, and, it must be added, that at least one further stop 55 is disposed in the deflection path of the arm carrying the eyelet, in order to vary the deflection characteristics thereof.

In this connection, it is intended that on the free end of the eyelet-free arm 51,52, there engages a restoring spring 58, the other end of which is attached to an anchoring fixture 57 on the base 1 of the loom.

Figures 2, 3:
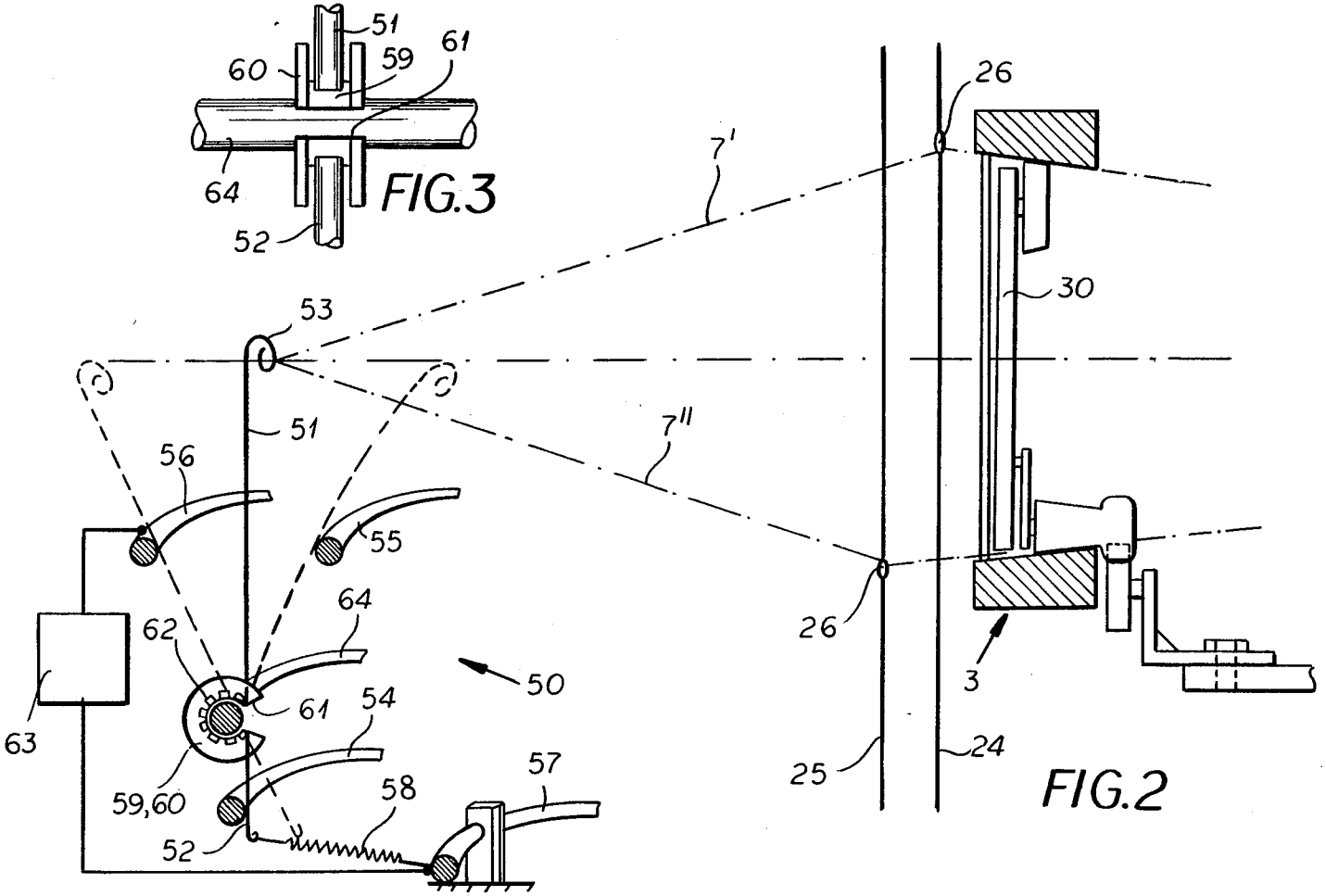
FIG. 2 is a schematic representation in side view of the arrangement for tension control and supervision of the individual warp threads, according to invention and according to FIG. 1 on a larger scale.
FIG. 3 is a detail of the arrangement according to FIG. 2, in front view and on a larger scale.

As may be further seen in representation of FIGS. 2 and 3, the spring-wire movable lever 51,52, with a formed holder for lever 62, is seated on its pivot shaft 64 by way of a collar 59 with terminal flanges 60, which are interfacial and the shape of a disc, the clearance appoximately corresponding to the strength of the spring wire. In this connection, the collar 59 has a slot 61, parallel with the axle and serving to press the casing radially on the pivot shaft 64. The casing 59 consisting, moreover, of electric insulating material.

According to invention, the spring-wire movable lever 51,52, is, furthermore, a movable contact arm in the electric circuit of a switching arrangement 63 for producing a stop signal for the loom, with the one pole of the electric circuit consisting of the anchoring fixture 57 for the restoring spring 58, and the other pole consisting of the stop 56 that limits the signal position of the movable lever.

Further, it is indicated by FIG. 2 that all the spring-wire movable levers 51,52, the pivot shafts 64, the stops 54 and 55, the current-carrying signal position stop 56, as well as the current carrying anchoring fixture 57 for the restoring spring 58 in the form of circular surrounding rods, are common with the circular reed 3 resp. the shed-forming means 24,25,26.

From what has been previously described, it may easily be seen that, according to invention, this arrangement for tension control and supervision of individual warp threads is distinguished by its great simplicity and operating safety. In particular, the spring wire gives a very light and continuously exact movable lever, the spring characteristic of which can be adapted to the prevalent tension conditions in the simplest way, by a spring tension jump being attained on the stop 55 through the construction of the arm 51, carrying the eyelet 53. By determining the distance of the point of impact of the spring arm 51 away from the point of rotation, the characteristic can be altered. It is possible in this connection to make the stop 55 vertically adjustable. Moreover, it is also possible, for a further regulative, to provide a further stop above or below the stop 55.

Further, it may be seen that the movable arm is, together with the collar 59, through the specific disposition of the slotted casing, easily replaceable and possesses through the construction of the casing a perfect lateral guidance.

The employment of a spring wire as movable lever, allows for the simplest of developments as an arrangement for checking the warp threads by having the spring wire as current-carrying element function directly with the signal position stop 56, which is constructed as the opposite contact. As a result, each movable lever receives its electric connection with the mutual anchoring fixture 57 for the restoring spring 58 by this.

Thus, from the foregoing there results according to invention an arrangement for tension control and the supervision of individual warp threads on a circular loom. In particular, the aforesaid measures permit an easy changing over of those looms already standing, as well as the utilization of the warp thread regulating and supervisory arrangement on other thread-processing machines.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. Arrangement for tension control and supervision of individual warp threads on a loom comprising:

a two-armed movable lever, which is swivel-supported on the loom and which is held by a warp thread, said thread being found in a stretched state, a yarn guiding eyelet through which said warp thread is guided, said eyelet located on the end of one of said movable lever arms, a restoring spring means, which means engages on the lever arm that is free of said eyelet, said spring menas capable of compensating for the alternating tension on the warp thread, an electric circuit being closed when said movable lever is brought into signal position as a result of the unstretched or missing warp thread, said movable lever arm comprises a spring wire, the eyelet-free lever arm standing in the regulating position of the movable lever on a stop, the lever arm with the eyelet bending under increasing tension in the direction of withdrawal of the warp thread, a further stop being disposed in the deflection path of the arm carrying the eyelet, in order to vary the deflection characteristics thereof, and said two-arm movable lever being seated on a pivot shaft by way of a collar with terminal flanges, said flanges being interfacial and in the shape of a disc, the clearance approximately corresponding to the strength of said spring wire.

2. The warp thread tension control and supervisory arrangement as defined in claim 1, wherein:

said restoring spring means includes a restoring spring engaging on the free end of the eyelet-free lever arm and acts thereon in the direction of the signal position, the other end of said spring being attached to an anchoring fixture on the loom.

3. The warp thread tension control and supervision arrangement as defined in claim 2, wherein:

said spring-wire movable lever is a movable contact arm in the electric circuit of a switching arrangement for producing a stop signal for the loom, with the one pole of the electric circuit consisting of the anchoring fixture for the restoring spring, and the other pole consisting of the stop that limits the signal position of the movable lever and with the collar, which supports the movable lever, consisting of an electric insulating material.

4. The warp thread tension control and supervision arrangement as defined in claim 1, wherein:

said collar has a slot, parallel with the axle and serving to press the collar radially on the pivot shaft.

5. The warp thread tension control and supervisory arrangement as defined in claim 1 wherein said loom is a circular loom.

* * * * *